US011296468B2

(12) United States Patent
Cheng

(10) Patent No.: US 11,296,468 B2
(45) Date of Patent: Apr. 5, 2022

(54) POWER ADAPTER

(71) Applicant: Chicony Power Technology Co., Ltd., New Taipei (TW)

(72) Inventor: Chao-Cheng Cheng, New Taipei (TW)

(73) Assignee: CHICONY POWER TECHNOLOGY CO., LTD., New Taipei (TW)

( * ) Notice: Subject to any disclaimer, the term of this patent is extended or adjusted under 35 U.S.C. 154(b) by 82 days.

(21) Appl. No.: 17/033,878

(22) Filed: Sep. 27, 2020

(65) Prior Publication Data

US 2021/0273389 A1 Sep. 2, 2021

(30) Foreign Application Priority Data

Feb. 27, 2020 (TW) ..... 109106609

(51) Int. Cl.
*H01R 13/44* (2006.01)
*H01R 31/06* (2006.01)
*H01R 13/642* (2006.01)

(52) U.S. Cl.
CPC ..... *H01R 31/06* (2013.01); *H01R 13/642* (2013.01)

(58) Field of Classification Search
CPC ..... H01R 35/04; H01R 29/00; H01R 27/00; H01R 13/03; H01R 31/06
See application file for complete search history.

(56) References Cited

U.S. PATENT DOCUMENTS 4,668,845 A 5/1987 Izumi
5,613,863 A * 3/1997 Klaus ..... H01R 31/06 D13/110
5,628,641 A * 5/1997 Hahn ..... H01R 27/00 439/131
5,791,921 A * 8/1998 Lee ..... H01R 27/00 439/651
5,967,807 A * 10/1999 Wu ..... H01R 31/06 439/131

(Continued)

FOREIGN PATENT DOCUMENTS

CN 2438238 Y 7/2001
CN 202084691 U 12/2011

(Continued)

OTHER PUBLICATIONS

Office Action dated May 20, 2021 of the corresponding Taiwan patent application No. 109106609.

*Primary Examiner* — Thanh Tam T Le
(74) *Attorney, Agent, or Firm* — Chun-Ming Shih; HDLS IPR Services

(57) ABSTRACT

A power adapter is disclosed. The first guiding slot of the movable member is inserted with the shaft rod of the plug assembly, and the crack arm performs a rotation around a fixed axis about the shell. Additionally, the second guiding slot of the movable member and the post of the socket assembly are embedded for sliding. The movable member slides in two different directions to drive the socket assembly performing an ascending and lowering movements in a vertical direction, and the plug assembly is driven to rotate around a fixed axis at the same time. Thereby, the overall height is reduced to facilitate storage and carry; additionally, each pin can be stored in the shell to prevent the bag from being pierced and prevent other items in the bag from being scratched.

10 Claims, 8 Drawing Sheets

(56) References Cited

U.S. PATENT DOCUMENTS

| | | | | |
|---|---|---|---|---|
| 6,126,460 | A * | 10/2000 | Wu | H01R 35/04 439/640 |
| 6,659,782 | B2 * | 12/2003 | Wu | H01R 31/065 439/131 |
| 6,821,134 | B2 * | 11/2004 | Chen | H01R 35/04 439/11 |
| 7,638,968 | B2 * | 12/2009 | Inoue | H01R 31/06 439/131 |
| 7,938,653 | B2 * | 5/2011 | Hopwood | H01R 24/28 439/131 |
| 8,388,383 | B2 * | 3/2013 | Tsai | H01R 31/06 439/628 |
| 9,318,834 | B2 * | 4/2016 | Hsu | H01R 24/68 |
| 9,583,875 | B2 | 2/2017 | Griepenstroh | |
| 9,716,329 | B1 * | 7/2017 | Tien | H01R 24/28 |
| 9,721,735 | B2 * | 8/2017 | Hsu | H01R 24/30 |
| 10,181,671 | B2 * | 1/2019 | Ma | H01R 13/502 |
| 10,389,059 | B1 * | 8/2019 | Li | H01R 31/065 |
| 10,992,093 | B1 * | 4/2021 | Lee | H01R 31/06 |
| 2002/0090848 | A1 * | 7/2002 | Yu | H01R 13/44 439/131 |
| 2004/0209499 | A1 * | 10/2004 | Chung | H01R 35/04 439/131 |

FOREIGN PATENT DOCUMENTS

| | | | |
|---|---|---|---|
| CN | 104836050 | A | 8/2015 |
| TW | M256005 | U | 1/2005 |
| TW | I280699 | B | 5/2007 |
| TW | I352468 | B | 11/2011 |
| TW | M447015 | U | 2/2013 |
| TW | I425725 | B | 2/2014 |
| TW | I427875 | B | 2/2014 |
| TW | M525563 | U | 7/2016 |
| TW | I559632 | B | 11/2016 |
| TW | M546610 | U | 8/2017 |

* cited by examiner

POWER ADAPTER

BACKGROUND OF THE INVENTION

Field of the Invention

The present invention generally relates to an adapter and, in particular to a power adapter.

Description of Prior Art

With the current demands of the electronics industry and the prosperous development of portable electronic products, plans for electronic products have gradually been improved to bolster portability and mobility. For users who frequently need to stay away from home and travel abroad, power adapters are usually needed to be used in various occasions, and power adapters are required to be stored in backpacks or carry-on storages for carry easily.

However, most existing power adapters are either fixed plugs or sockets, which are not only large in size and thickness but also inconvenient to carry. Furthermore, the fixed metal plugs often pierce the bag or other items therein, and which is worrisome for users.

In view of the above drawbacks, the inventor proposes the present invention based on his expert knowledge and elaborate research in order to solve the problems of prior art.

SUMMARY OF THE INVENTION

Accordingly, an object of the present invention is to provide a power adapter to reduce the overall height to facilitate storage and portability.

In order to achieve the object mentioned above, the present invention provides a power adapter comprising a shell, a movable member, a plug assembly and a socket assembly. The shell has an accommodation space inside, and an outside of the shell has a first surface and a second surface located on an opposite side of the first surface. The movable member is installed in the accommodation space, and the movable member is provided with a first guiding slot and a second guiding slot. The plug assembly includes a crank arm, a shaft rod rotatably connected with the crank arm, and a first pin and a second pin fixed on the crank arm, wherein the crank arm is accommodated in the accommodation space and is pivoted at the shell, and one end of the shaft rod is slidably embedded in the first guiding slot. The socket assembly includes a base and a post connected with the base, wherein the base is movably accommodated in the accommodation space, and the post is slidably embedded in the second guiding slot. When the movable member moves in one direction to drive the first pin and the second pin rotating to protrude from the first surface, the base is ascended from the second surface simultaneously. When the movable member is moved in another direction, the first pin and the second pin will be driven to rotate into the first surface, and the base will be hidden into the second surface simultaneously.

The invention also has the following effects. The overall height can be reduced through each pin and the base can be stored in the shell to facilitate storage and carry; additionally, the bag can be prevented from being punctured or other items in the bag from being scratched.

BRIEF DESCRIPTION OF DRAWING

The features of the invention believed to be novel are set forth with particularity in the appended claims. The invention itself, however, may be best understood by reference to the following detailed description of the invention, which describes a number of exemplary embodiments of the invention, taken in conjunction with the accompanying drawings, in which:

DETAILED DESCRIPTION OF THE PREFERRED EMBODIMENTS

Figure 1:
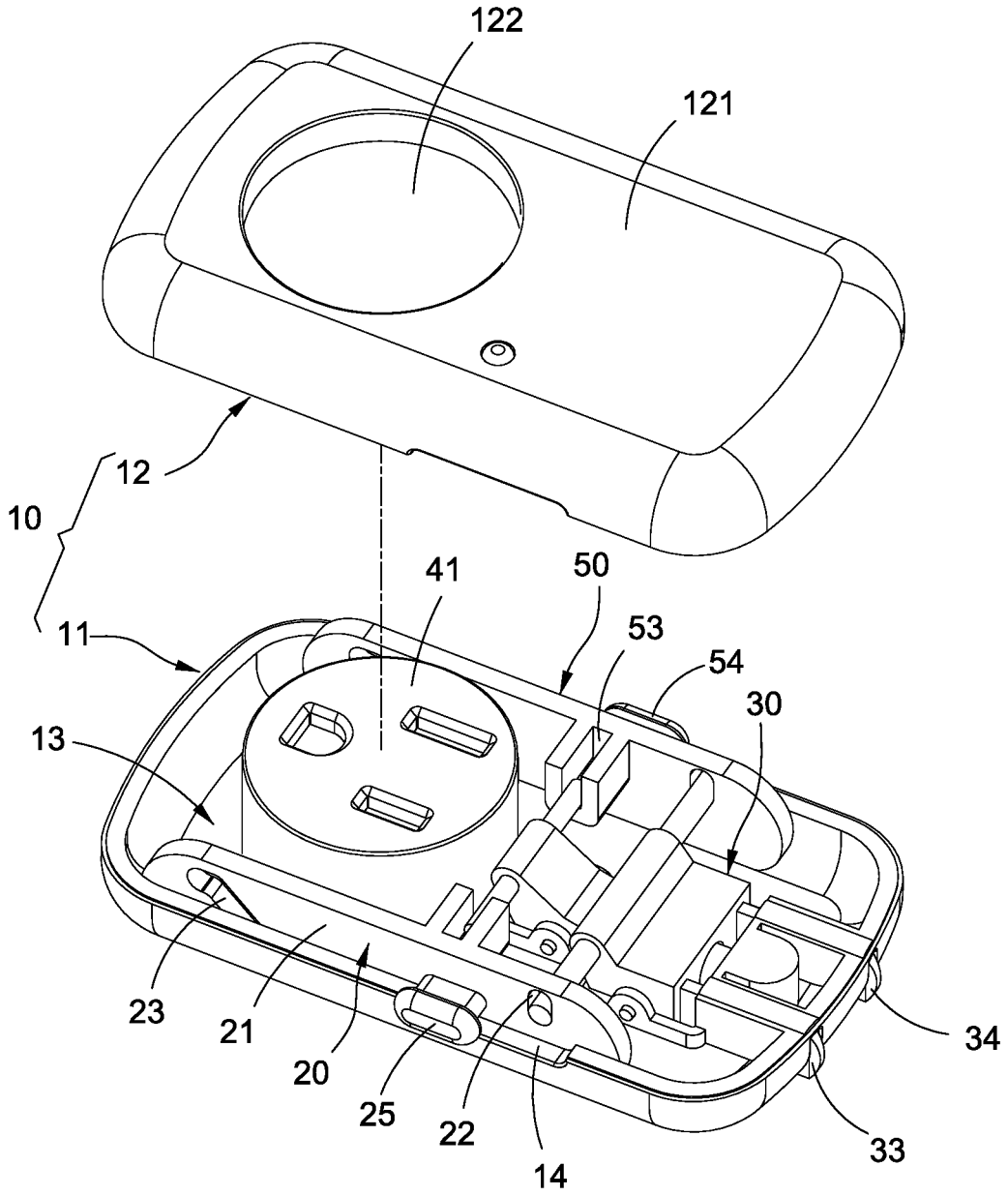
FIG. 1 is an explosion view of the power adapter of the present invention after removing the upper shell.
Figure 2:
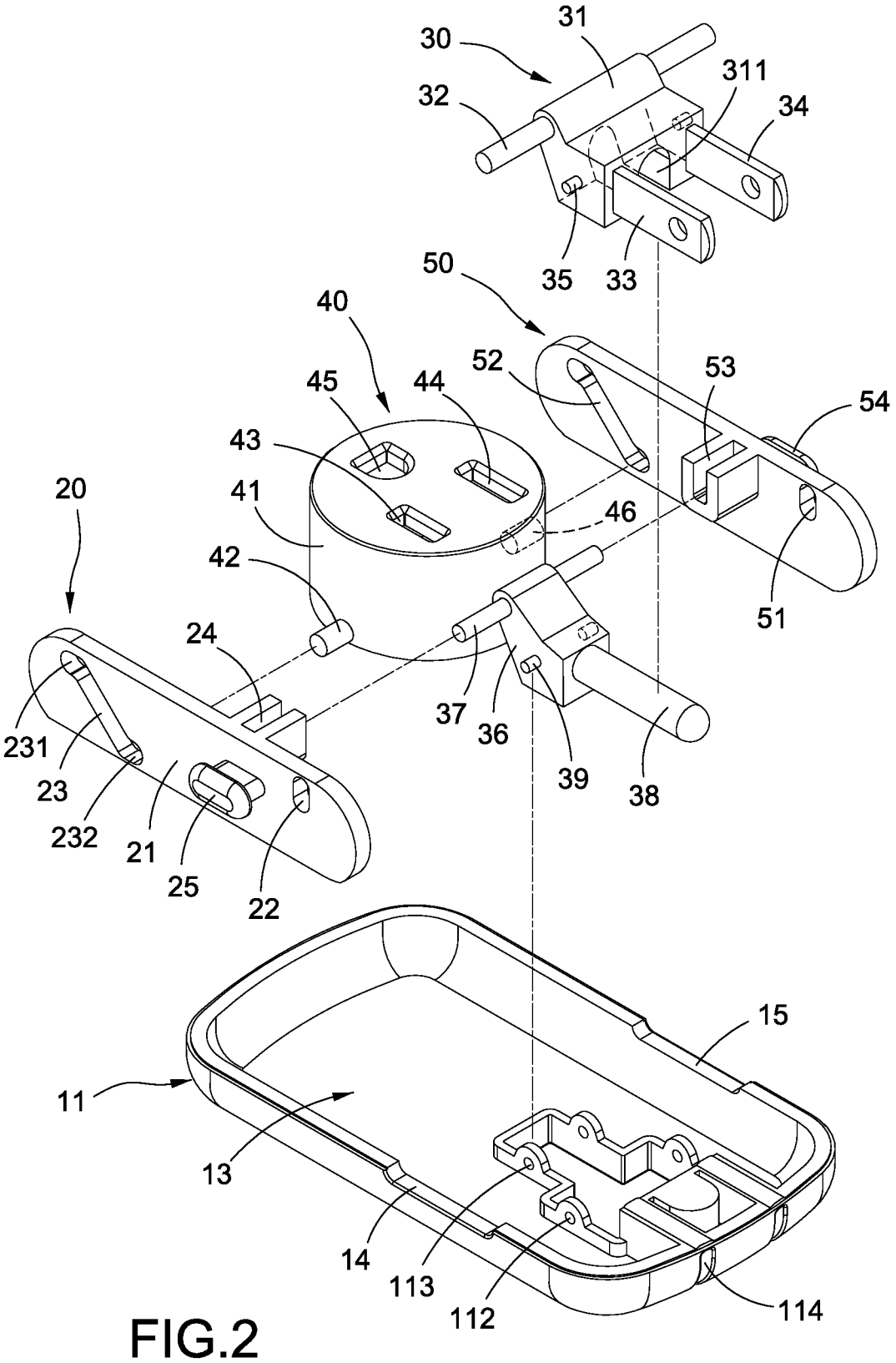
FIG. 2 is an explosion view of the power adapter of the present invention.
Figure 3:
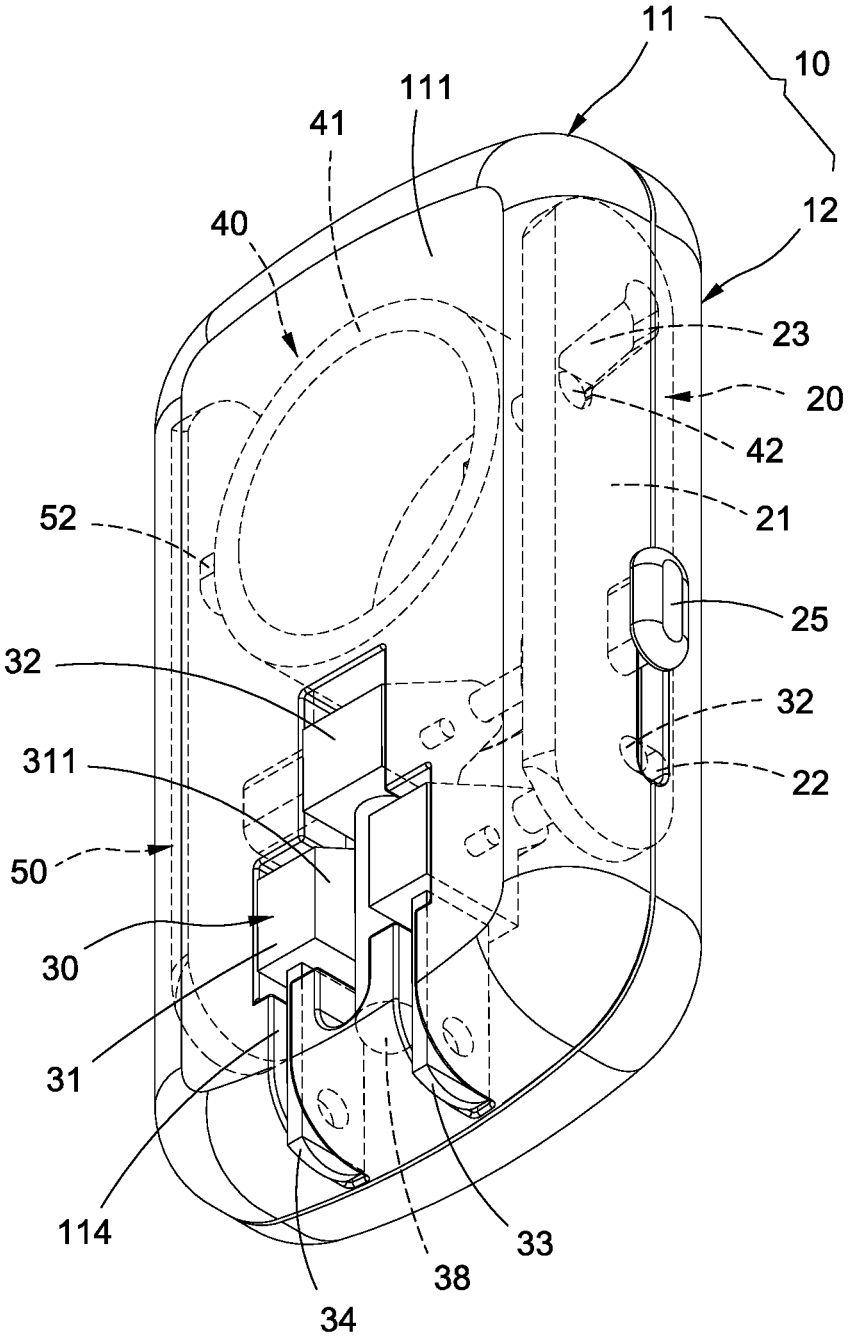
FIG. 3 is a perspective assembly view of the power adapter of the present invention.
Figure 4:
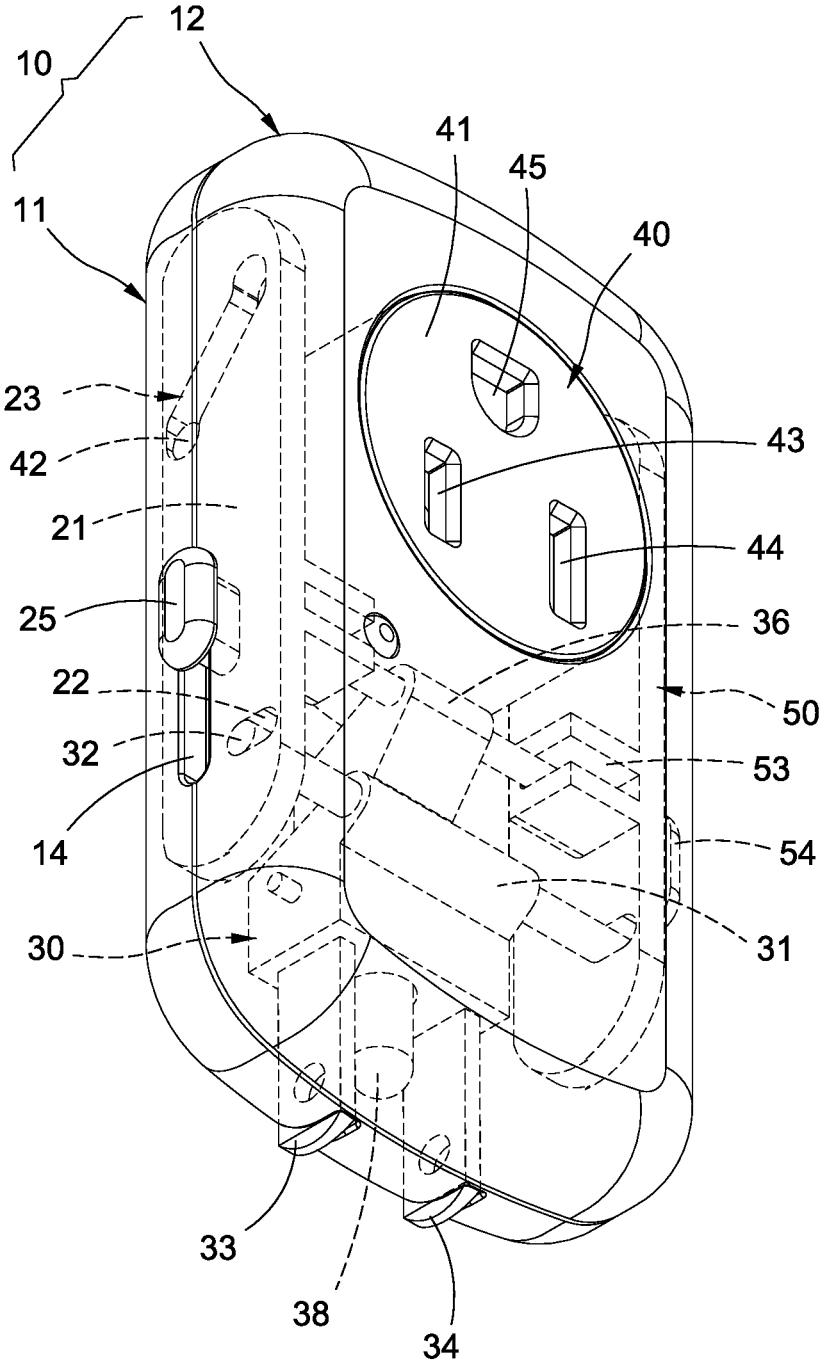
FIG. 4 is another perspective view of the power adapter of the present invention.
Figure 5:
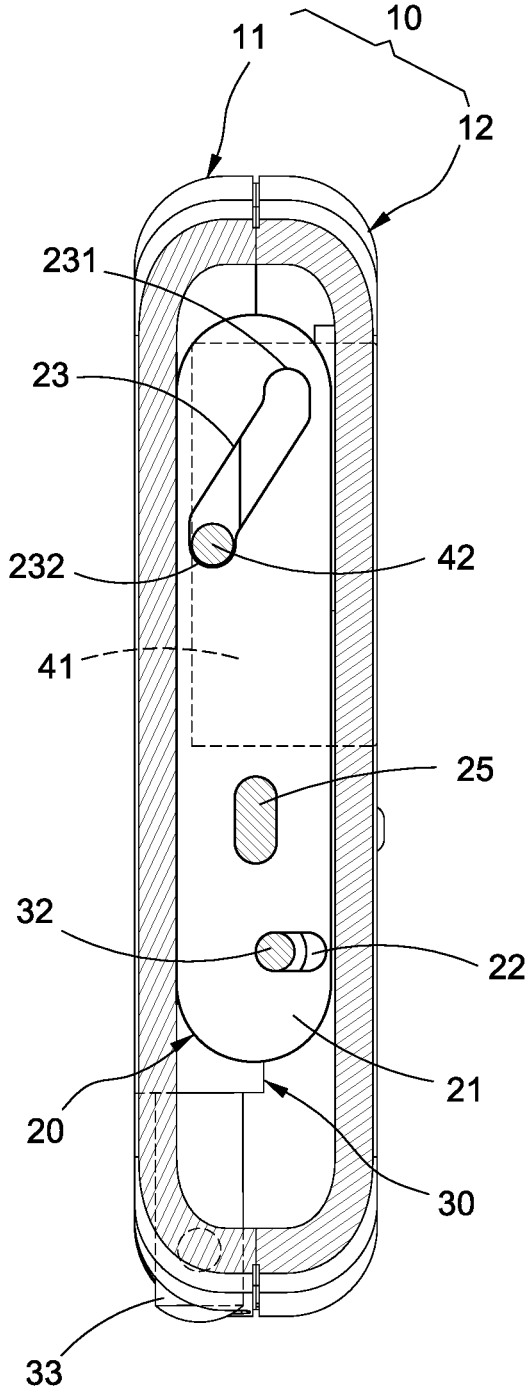
FIG. 5 is a cross sectional view of the power adapter of the present invention.

In cooperation with attached drawings, the technical contents and detailed description of the invention are described thereinafter according to a number of preferable embodiments, not being used to limit its executing scope. Any equivalent variation or modification made according to appended claims is all covered by the claims claimed by the present invention.

Please refer to FIG. 1 to FIG. 5. The present invention provides a power adapter including a shell 10, a movable member 20, a plug assembly 30, and a socket assembly 40.

In the present embodiment, the shell 10 mainly includes a lower shell 11 and an upper shell 12 corresponding to the lower shell 11 as a cover, and an accommodation space 13 is enclosed by the upper shell 12 and the lower shell 11 inside. The lower shell 11 can be made of insulation plastic materials, and the outside (convex side) of the shell has a first surface 111. (see FIG. 3). Additionally, a pivot hole 112 and a shaft hole 113 are provided at the right side of the lower shell 11, and two pin receptacles 114 are formed on the lower shell 11 and at the right side of the pivot hole 112.

The outside of the upper shell 12 has a second surface 121 at the outside (convex side) thereof. The second surface 121 is located at an opposite side to the first surface 111 of the lower shell 11 after the upper shell 12 covers the lower shell 11 correspondingly. In addition, a socket opening 122 is provided at the left side of the upper shell 12.

The movable member 20 is installed in the accommodation space 13 and mainly includes a plate 21, wherein a first guiding slot 22 and a second guiding slot 23 are provided on the front and rear sides of the plate 21 respectively. After the movable member 20 is installed in the lower shell 11, the extending direction of the first guiding groove 22 is perpendicular to the first surface 111. The second guiding slot 23 extends from a side of the movable member 20 neighboring the first surface 111 toward a side of the movable member 20 neighboring the second surface 121 in a direction away from the first guiding slot 22. In the present embodiment, the second guide groove 23 is configured in an S shape substantially.

The plug assembly 30 includes a crank arm 31, a shaft rod 32 rotatably connected with the crank arm 31, and a first pin 33 and a second pin 34 fixed to the crank arm 31 and spaced apart. The crank arm 31 is accommodated in the accommodation space 13 and pivoted at the pivot hole 112 of the lower shell 11 through a pivot shaft 35, and one end of the shaft rod 32 is slidably embedded in the first guiding slot 22. The cross sections of the first pin 33 and the second pin 34 are rectangular separately.

The socket assembly 40 includes a base 41 and a post 42 connected with the base 41. The base 41 is movably accommodated in the accommodation space 13, and the post 42 is slidably embedded in the second guiding slot 23. Moreover, an upper latching portion 231 and a lower latching portion 232 are provided on the upper and lower ends of the second guiding groove 23 respectively, so that the post 42 can be held stably when it reaches the extreme positions.

Further, the movable member 20 further includes a third guiding slot 24 located between the first guiding slot 22 and the second guiding slot 23. The plug assembly 30 further includes a single-pin crank arm 36 located between the crank arm 31 and the socket assembly 40 and pivotally at the shell 10, a single-pin shaft rod 37 located between the shaft rod 32 and the socket assembly 40 and rotatably connected with the single-pin crank arm 36, and a third pin 38 fixed to the single-pin crank arm 36.

Preferably, the single-pin crank arm 36 is accommodated in the accommodation space 13 and pivotally at the shaft hole 113 of the lower shell 11 through a shaft rod 39, and one end of the single-pin shaft rod 37 is slidably embedded in the third guiding groove 24. The crank arm member 31 is provided with a single pin receptacle 311 at a location corresponding to the third pin 38, so as to provide a hidden folding space for the third pin 38.

Preferably, the socket assembly 40 further includes a first conductor 43, a second conductor 44, and a third conductor 45 embedded in the base 41, wherein the first conductor 43, the second conductor 44, and the third conductor 45 are electrically connected to the first pin 33, the second pin 34 and the third pin 38 respectively. The cross section of the third pin 38 is circular, and the third pin 38 moves with the first pin 33 and the second pin 34 simultaneously.

The crank arm 31 of the present invention is stably pivoted at the pivot hole 112 of the lower shell 11 through a pivot shaft 35, so that the crank arm 31 has a freedom of rotation in one direction. Therefore, the rotation of the crank arm 31 can be achieved only by the movement of the movable member 20. Similarly, the bottom section of the base 41 is connected with the first pin 33 and the second pin 34 for positioning, and the top section of the base 41 is received and positioned by the socket opening 122 of the upper shell 12. The upper and lower ends of the base 41 are stably positioned to have a degree of freedom longitudinally only, so that the base 41 can be rotated and raised by the movement of the movable member 20.

Furthermore, the power adapter of the present invention further comprises an auxiliary moving member 50 located in the accommodation space 13 and disposed symmetrically with the movable member 20 to increase the overall structural strength and stability during operation. The auxiliary moving member 50 is provided with a fourth guiding slot 51, a fifth guiding slot 52, and a sixth guiding slot 53 located between the fourth guiding slot 51 and the fifth guiding slot 52, wherein another end of the shaft rod 32 is slidably embedded in the fourth guiding slot 51. The socket assembly 40 further includes another post 46 connected with the base 41 and slidably embedded in the fifth guiding slot 52, and another end of the single-pin shaft rod 37 is slidably embedded in the sixth guiding slot 53.

Further, after the auxiliary moving member 50 is installed in the accommodation space 13 of the shell 10, the fifth guiding slot 52 extends from a side of the auxiliary moving member 50 neighboring the first surface 111 toward a side of the auxiliary moving member 50 neighboring the second surface 121 in a direction away from the fourth guiding slot 51. Additionally, an extending direction of the fourth guiding slot 51 is perpendicular to the first surface 111.

Preferably, the shell 10 further includes a first groove 14 provided corresponding to the movable member 20 and a second groove 15 provided corresponding to the auxiliary moving member 50. The movable member 20 further includes a first bump 25 connected between the first guiding slot 22 and the second guiding slot 23 which is slidably inserted in the first groove 14. The auxiliary moving member 50 further includes a second bump 54 connected between the fourth guiding slot 51 and the fifth guiding slot 52 which is slidably inserted in the second groove 15. The first bump 25 and the second bump 54 are provided for a user applying a force to slide the movable member 20 and the auxiliary movable member 50.

Figure 6:
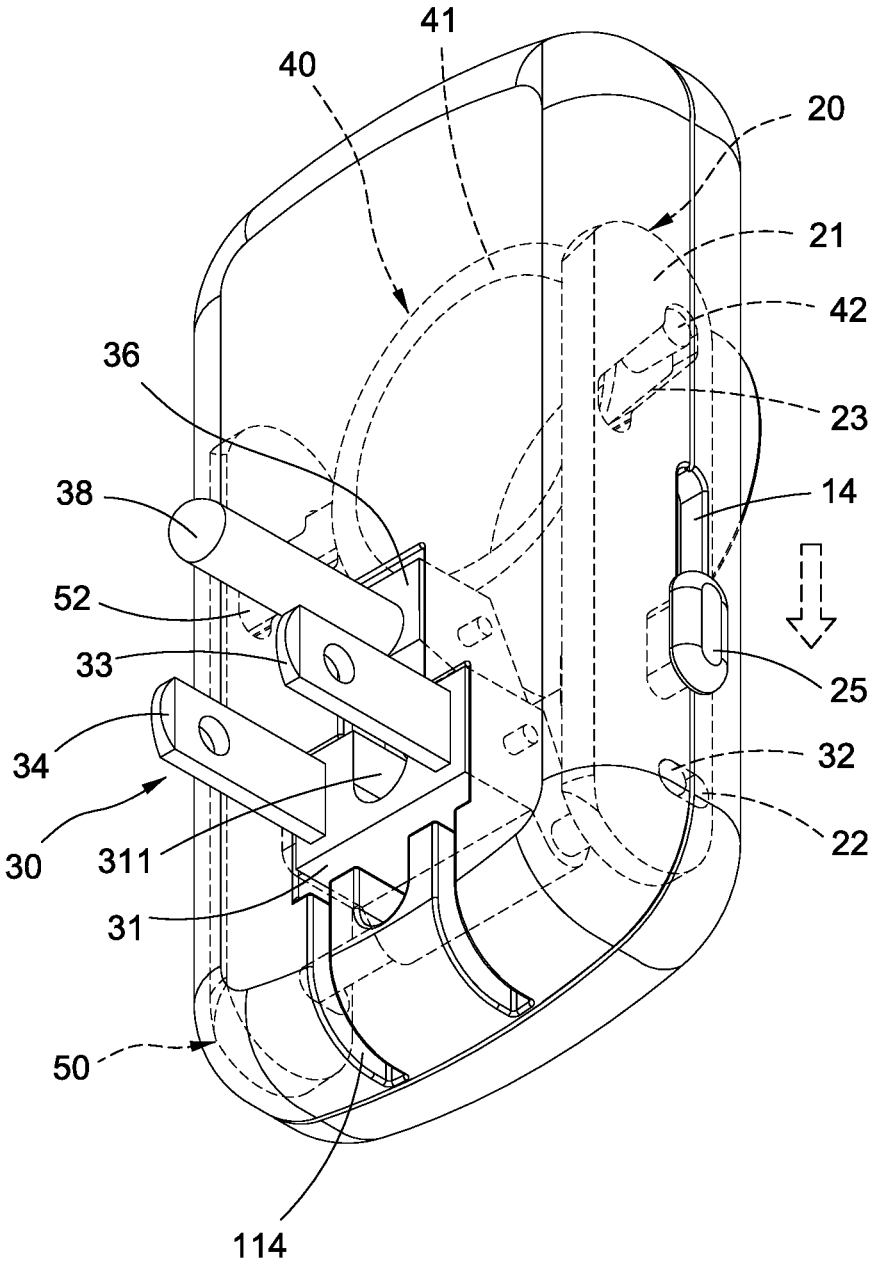
FIG. 6 is a perspective view of using the power adapter of the present invention.
Figure 7:
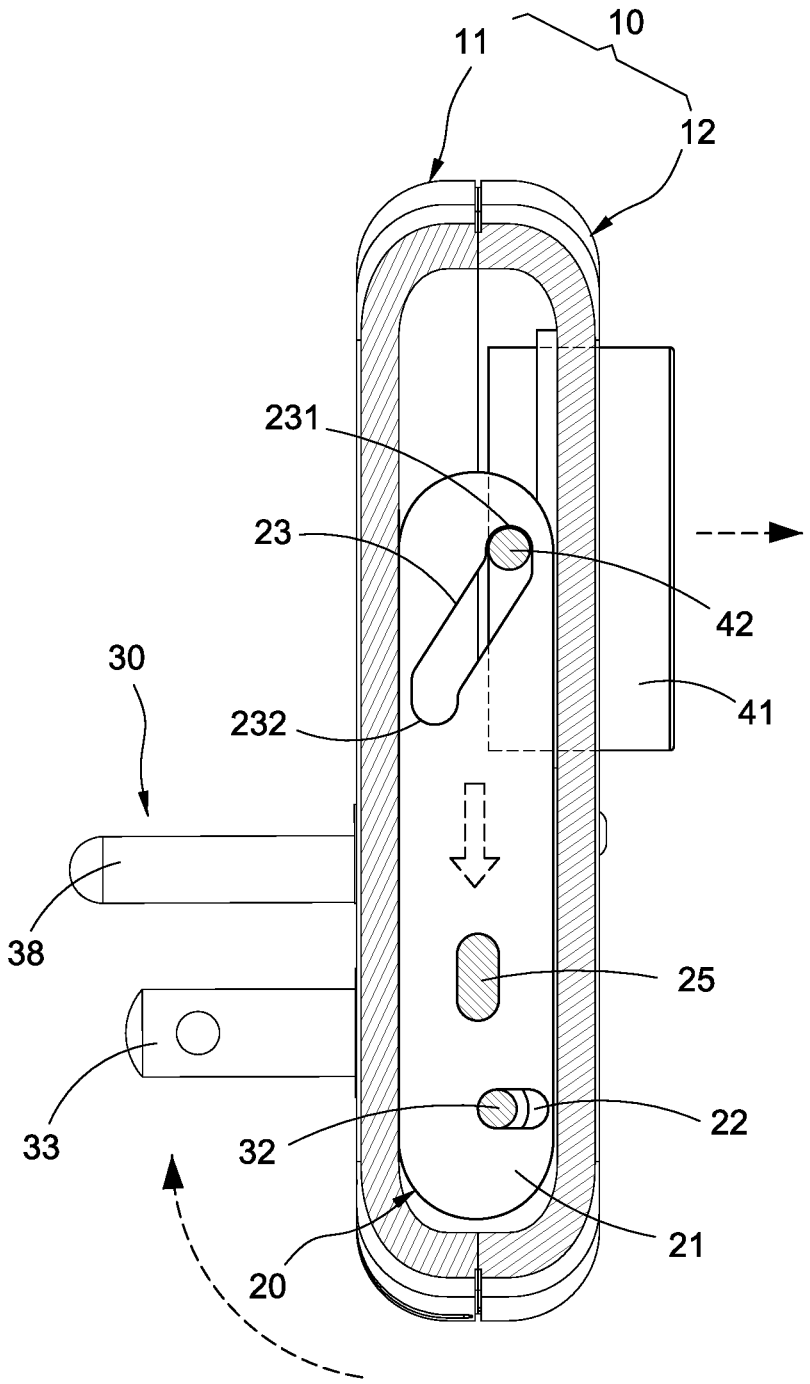
FIG. 7 is a cross sectional view of using the power adapter of the present invention.
Figure 8:
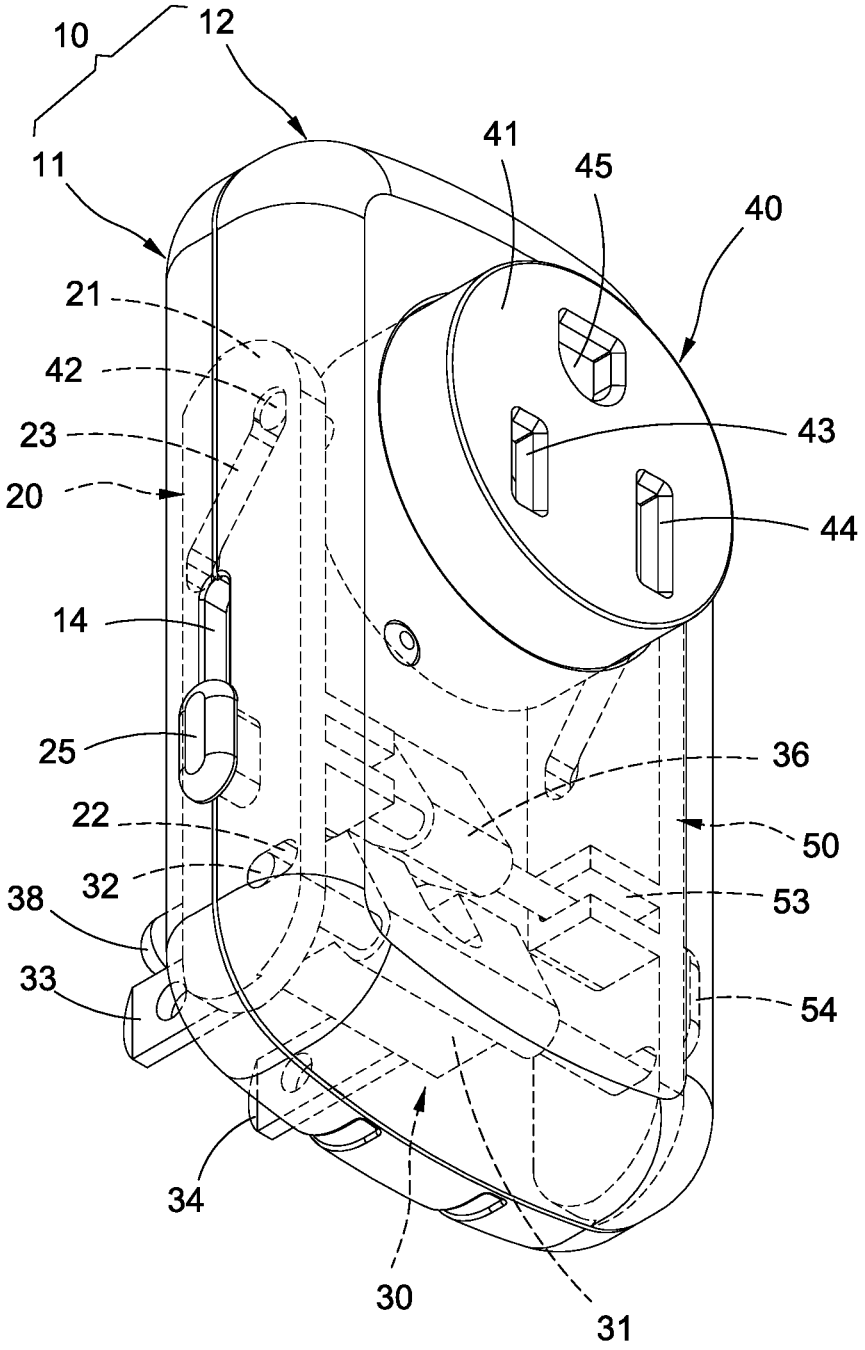
FIG. 8 is another perspective view of using the power adapter of the present invention.

Please refer to FIG. 6 to FIG. 8, the movable member 20 and the auxiliary movable member 50 are moved in one direction by pushing the first bump 25 and the second bump 54 when in use. As two ends of the shaft rod 32 are located in the first guiding slot 22 and the fourth guiding slot 51 separately to slide up or down and drive the crank arm 31 performing a rotation about the fixed axis around the pivot 35 as the rotation center, and the first pin 33 and the second pin 34 can protrude from the first surface 111 in a rotating manner. At the same time, each of the posts 42, 46 is accommodated in the second guiding slot 23 and the fifth guiding slot 52 separately and slides obliquely to raise the base 41 to protrude from the second surface 121.

On the other hand, when the movable member 20 and the auxiliary movable member 50 are moved in another direction and drive the first pin 33 and the second pin 34 to rotate to a position hidden into the first surface 111, the base 41 will be hidden into the second surface 121 simultaneously.

Moreover, the third guiding slot 24 of the movable member 20 and the sixth guiding slot 53 of the auxiliary moving member 50 are provided for the two ends of the single-pin shaft rod 37 to slide up or down. When the movable member 20 and the auxiliary moving member 50 are moved in one direction, the single-pin crank arm 36 is driven to perform a rotation about the fixed axis with the shaft rod 39 as the rotation center. Thereby, the third pin 38 moves with the first pin 33 and the second pin 34 simultaneously to protrude from the first surface 111 in a rotating manner. When the movable member 20 and the auxiliary moving member 50 are moved in another direction to drive the third pin 38 moving, the first pin 33 and the second pin 34 are simultaneously hidden into the first surface 111.

Further, in some embodiments of the present invention, the first bump 25 and the second bump 54 may not be provided. Whether or not the first bump 25 and the second bump 54 are provided, users can rotate out the first pin 33 and the second pin 34 from the pin receptacles 114 of the shell 10 to protrude from the first surface 111. At the time, the third pin 38 will rotate out of the first surface 111 synchronously, and the movable member 20 and the auxiliary moving member 50 also slide and move to drive the base 41 to protrude from the second surface 121. Users can also rotate the first pin 33 and the second pin 34 back to the pin receptacles 114 to be hidden into the first surface 111. At this time, the third pin 38 will be rotated into the first surface 111 synchronously, wherein the movable member 20 and the auxiliary moving member 50 also slide and move to drive the base 41 hidden into the second surface 121.

In summary, in the power adapter of the present invention, the first guiding slot of the movable member is inserted with the shaft rod of the plug assembly, and the crack arm performs a rotation around a fixed axis about the shell. In addition, the second guiding slot of the movable member and the post of the socket assembly are embedded to slide, so that the movable member can drive the plug assembly to rotate around a fixed axis while moving, and the socket assembly is driven to perform a raising and lowering movement in the vertical direction. In this method, the overall height can be reduced to facilitate storage and carry; additionally, each pin can be rotated to the shell to prevent the bag from being pierced and prevent other items in the bag from being scratched.

Although the present invention has been described with reference to the preferred embodiment thereof, it will be understood that the invention is not limited to the details thereof.

Various substitutions and improvements have been suggested in the foregoing description, and others will occur to those of ordinary skill in the art. Therefore, all such substitutions and improvements are intended to be embraced within the scope of the invention as defined in the appended claims.

What is claimed is:

1. A power adapter, comprising:

a shell having an accommodation space inside, wherein an outside of the shell has a first surface and a second surface located on an opposite side of the first surface;

a movable member installed in the accommodation space, wherein the movable member is provided with a first guiding slot and a second guiding slot;

a plug assembly including a crank arm, a shaft rod rotatably connected to the crank arm, and a first pin and a second pin fixed to the crank arm, wherein the crank arm is accommodated in the accommodation space and pivoted at the shell, and one end of the shaft rod is slidably embedded in the first guiding slot; and a socket assembly including a base and a post connected with the base, wherein the base is movably accommodated in the accommodation space, and the post is slidably embedded in the second guiding slot;

wherein, when the movable member moves in one direction to drive the first pin and the second pin rotating to protrude from the first surface, the base protrudes from the second surface simultaneously; and when the movable member moves in another direction to drive the first pin and the second pin rotating to be hidden into the first surface, the base is hidden into the second surface simultaneously.

2. The power adapter according to claim 1, wherein the second guiding slot extends from a side of the movable member neighboring the first surface toward a side of the movable member neighboring the second surface in a way away from the first guiding slot.

3. The power adapter according to claim 1, wherein an extending direction of the first guiding slot is perpendicular to the first surface.

4. The power adapter according to claim 1, wherein the shell further includes a first groove corresponding to the movable member, and the movable member further includes a first bump connected between the first guiding slot and the second guiding slot slidably inserted in the first groove, wherein the first bump is provided for a user applying a force to slide the movable member.

5. The power adapter according to claim 1, wherein the movable member further includes a third guiding slot located between the first guiding slot and the second guiding slot; the plug assembly further includes a single-pin crank arm located between the crank arm and the socket assembly and pivotally at the shell, a single-pin shaft rod located between the shaft rod and the socket assembly and rotatably connected with the single-pin crank arm, and a third pin fixed to the single-pin crank arm, wherein one end of the single-pin shaft rod is slidably embedded in the third guiding groove, and the socket assembly further includes a first conductor, a second conductor, and a third conductor embedded in the base, wherein the first conductor, the second conductor, and the third conductor are electrically connected with the first pin, the second pin and the third pin respectively.

6. The power adapter according to claim 5, wherein the third pin moves with the first pin and the second pin simultaneously.

7. The power adapter according to claim 5, further comprising an auxiliary moving member located in the accommodation space and disposed symmetrically with the movable member, wherein the auxiliary moving member is provided with a fourth guiding slot, a fifth guiding slot, and a sixth guiding slot located between the fourth guiding slot and the fifth guiding slot, wherein another end of the shaft rod is slidably embedded in the fourth guiding slot; the socket assembly further includes another post connected with the base and slidably embedded in the fifth guiding slot; and another end of the single-pin shaft rod is slidably embedded in the sixth guiding slot.

8. The power adapter according to claim 7, wherein the fifth guiding slot extends from a side of the auxiliary moving member neighboring the first surface toward a side of the auxiliary moving member neighboring the second surface in a way away from the fourth guiding slot.

9. The power adapter according to claim 7, wherein an extending direction of the fourth guiding slot is perpendicular to the first surface.

10. The power adapter according to claim 7, wherein the shell further includes a first groove disposed corresponding to the movable member and a second groove disposed corresponding to the auxiliary moving member; the movable member further includes a first bump connected between the first guiding slot and the second guiding slot and being slidably inserted in the first groove; the auxiliary moving member further includes a second bump connected between the fourth guiding slot and the fifth guiding slot and being slidably inserted in the second groove; wherein the first bump and the second bump are provided for a user applying a force to slide the movable member and the auxiliary moving member.

* * * * *